US007455118B2

(12) United States Patent
Roberts et al.

(10) Patent No.: US 7,455,118 B2
(45) Date of Patent: Nov. 25, 2008

(54) SECONDARY LOCK FOR A DOWNHOLE TOOL

(75) Inventors: William M. Roberts, Tomball, TX (US); George J. Melenyzer, Tomball, TX (US)

(73) Assignee: Smith International, Inc., Houston, TX (US)

( * ) Notice: Subject to any disclaimer, the term of this patent is extended or adjusted under 35 U.S.C. 154(b) by 194 days.

(21) Appl. No.: 11/392,112

(22) Filed: Mar. 29, 2006

(65) Prior Publication Data

US 2007/0227745 A1 Oct. 4, 2007

(51) Int. Cl.
*E21B 33/12* (2006.01)

(52) U.S. Cl. ..... 166/387; 166/134

(58) Field of Classification Search ..... 166/134, 166/387

See application file for complete search history.

(56) References Cited

U.S. PATENT DOCUMENTS

| | | | | | |
|---|---|---|---|---|---|
| 2,845,127 | A | * | 7/1958 | Breaux | 166/134 |
| 3,066,738 | A | * | 12/1962 | Myers | 166/149 |
| 3,298,440 | A | * | 1/1967 | Current | 277/340 |
| 3,459,261 | A | | 8/1969 | Cochran | |
| 3,623,551 | A | * | 11/1971 | Randermann, Jr. | 166/134 |
| 4,044,826 | A | * | 8/1977 | Crowe | 166/120 |
| 4,224,987 | A | | 9/1980 | Allen | |
| 4,326,588 | A | * | 4/1982 | McStravick | 166/387 |
| 4,423,777 | A | | 1/1984 | Mullins et al. | |

(Continued)

FOREIGN PATENT DOCUMENTS

GB 2069571 8/1981

(Continued)

OTHER PUBLICATIONS

Combined Search and Examination Report issued in corresponding GB Application No. GB0803700.4, dated Mar. 18, 2008, (3 pages).

(Continued)

*Primary Examiner*—David J. Bagnell
*Assistant Examiner*—Cathleen R Hutchins
(74) *Attorney, Agent, or Firm*—Osha · Liang LLP

(57) ABSTRACT

A downhole tool includes a mandrel, a sealing element disposed around the mandrel, an upper cone disposed above the sealing element and a lower cone disposed below the sealing element, an upper slip assembly disposed above the upper cone and a lower slip assembly disposed below the sealing element, at least one lock ring configured to maintain energization of the sealing element when the downhole tool is set, and a secondary lock that couple the upper cone with the at least one lock ring. A method of increasing pack-off force of a downhole tool includes setting the downhole tool and energizing further the sealing element by applying a differential pressure to the downhole tool. A method of retrofitting a downhole tool includes providing a secondary lock disposed around a mandrel, the secondary lock including at least one arm having an axial portion extending downwardly therefrom and a threaded portion, and assembling the secondary lock to the downhole tool, the assembling including engaging the threaded portion of the secondary lock to a threaded surface of an upper cone disposed around the mandrel of the downhole tool.

16 Claims, 10 Drawing Sheets

U.S. PATENT DOCUMENTS

| | | | | | |
|---|---|---|---|---|---|
| 4,457,369 | A * | 7/1984 | Henderson | 166/125 |
| 4,627,491 | A * | 12/1986 | Zunkel | 166/126 |
| 4,730,835 | A * | 3/1988 | Wilcox et al. | 277/342 |
| 4,862,967 | A * | 9/1989 | Harris | 166/387 |
| 4,924,941 | A | 5/1990 | Farley | |
| 4,934,459 | A * | 6/1990 | Baugh et al. | 166/380 |
| 5,487,427 | A * | 1/1996 | Curington | 166/382 |
| 5,701,959 | A | 12/1997 | Hushbeck et al. | |
| 6,102,117 | A * | 8/2000 | Swor et al. | 166/138 |
| 6,241,017 | B1 * | 6/2001 | Doane et al. | 166/134 |
| 6,536,532 | B2 * | 3/2003 | Doane | 166/387 |
| 6,581,681 | B1 * | 6/2003 | Zimmerman et al. | 166/135 |
| 6,719,063 | B2 * | 4/2004 | Adams et al. | 166/382 |
| 6,880,642 | B1 * | 4/2005 | Garrett et al. | 166/382 |
| 6,935,431 | B2 | 8/2005 | Dewey et al. | |
| 7,080,693 | B2 * | 7/2006 | Walker et al. | 166/387 |
| 2005/0189103 | A1 | 9/2005 | Roberts et al. | |

FOREIGN PATENT DOCUMENTS

| | | |
|---|---|---|
| GB | 2337064 | 11/1999 |
| GB | 2372768 | 9/2002 |

OTHER PUBLICATIONS

Combined Search and Examination Report dated Jun. 5, 2007 issued in Patent Application No. GB0706053.6 (7 pages).

* cited by examiner

SECONDARY LOCK FOR A DOWNHOLE TOOL

BACKGROUND OF INVENTION

1. Field of the Invention

The invention relates generally to methods and apparatus for drilling and completing well bores. More specifically, the invention relates to methods and apparatus for an secondary lock for a downhole tool.

2. Background Art

In the drilling, completing, or reworking of oil wells, a great variety of downhole tools are used. For example, but not by way of limitation, it is often desirable to seal tubing or other pipe in the casing of a well, such as when it is desired to pump cement or other slurry down the tubing and force the cement or slurry around the annulus of the tubing or out into a formation. In some instances, perforations in the well in one section need to be isolated from perforations in a second section of the well. Typically, the wellbore is lined with tubular or casing to strengthen the sides of the borehole and isolate the interior of the casing from the earthen walls therearound. In order to access production fluid in a formation adjacent the wellbore, the casing is perforated, allowing the production fluid to enter the wellbore and be retrieved at the surface of the well. In other situations, there may be a need to isolate the bottom of the well from the wellhead. It then becomes necessary to seal the tubing with respect to the well casing to prevent the fluid pressure of the slurry from lifting the tubing out of the well or for otherwise isolating specific zones in which a wellbore has been placed. In other situations, there may be a need to create a pressure seal in the wellbore allowing fluid pressure to be applied to the wellbore to treat the isolated formation with pressurized fluids or solids. Downhole tools, referred to as packers and bridge plugs, are designed for the aforementioned general purposes, and are well known in the art of producing oil and gas.

Traditional packers include a sealing element having anti-extrusion rings on both upper and lower ends and a series of slips above and/or below the sealing element. Typically, a setting tool would be run with the packer to set the packer. The setting may be accomplished hydraulically due to relative movement created by the setting tool when subjected to applied pressure. This relative movement causes the slips to move up cones and extend into the surrounding tubular. At the same time, the sealing element may be compressed into sealing contact with the surrounding tubular. The set may be held by a body lock ring, which may prevent reversal of the relative movement.

Conventional bridge plugs are mechanical devices including an anchoring mechanism and compressive set resilient packoff seals. FIG. 1 shows a section view of a well 10 with a wellbore 12 having a bridge plug 15 disposed within a wellbore casing 20. The bridge plug 15 is typically attached to a setting tool and run into the hole on wire line or tubing (not shown), and then actuated with, for example, a pyrotechnic or hydraulic system. As illustrated in FIG. 1, the wellbore is sealed above and below the bridge plug so that oil migrating into the wellbore through perforations 23 will be directed to the surface of the well.

FIG. 2 is a partial cross sectional view of a typical bridge plug 50. The bridge plug 50 generally includes a body portion 80, a sealing member 52 to seal an annular area between the bridge plug 50 and the inside wall of casing (not shown) therearound and frangible slips 56, 61. The sealing member 52 is disposed between an upper retaining portion, or cone, 55 and a lower retaining portion, or cone, 60. In operation, axial forces are applied to frangible slip 56 while the body 80 and frangible slip 61 are held in a fixed position. As the slip 56 moves down in relation to the body 80 and slip 61, the sealing member 52 is actuated, and the frangible slips 56, 61 are driven up cones 55, 60. In the bridge plug of FIG. 2, the frangible slips 56, 61 are "unidirectional" and are most effective against axial forces applied to the bridge plug in a single direction. The movement of the cones and slips also axially compress and radially expand the sealing member 52, thereby forcing the sealing portion radially outward from the plug to contact the inner surface of the wellbore casing. The compressed sealing member 52 provides a fluid seal to prevent the movement of fluids across the bridge plug.

In the past, downhole tools, including compression-set packers and bridge plugs with locking features, have been used to seal against the inside of the well casing or wellbore. In such downhole tools, slips are mechanically actuated to anchor the tool to the casing wall (or to the uncased wellbore). The elastomeric sealing element may then be energized by compressing the elastomeric sealing element between upper and lower cones. A lock ring having a ratchet system is often used to prevent the cones from slipping away from the seal energizing position.

It has been found that downhole tools may leak at high pressures unless they include a means for increasing the seal energization, such as a pressure responsive self-energizing feature. Leakage occurs because even when a high setting force is used to set the downhole tool seals, once the setting force is removed, the ratchet system of the lock ring will retreat slightly before being arrested by the locking effect created when the sets of ratchet teeth mate firmly at the respective bases and apexes of each. This may cause a loosening of the seal. Downhole tools are also particularly prone to leak if fluid pressures on the packers are cycled from one direction to the other.

There have been several suggested solutions in the past to the general problem of pressure-deactivation of well packers. Each of these proposed solutions attempts to increase the seal energizing force when fluid pressure is applied, in some cases from annulus pressure above or below the packer, and in at least one case from pressure applied through the central bore of the inner mandrel. An example of one such system system is disclosed in U.S. Pat. No. 4,224,987, issued Sep. 30, 1980, to Allen. Allen discloses a well packer using a combination of an upper movable sleeve and inner mandrel movement, to increase seal element energization from annulus pressure applied from above, and a movable piston to increase seal element energization from annulus pressure applied from below. An upper shoe and sleeve are slidably retained on the inner mandrel in engagement with the seal elements, and are responsive to fluid pressure applied from above. The upper shoe and sleeve move down in response to such pressure, further compressing the packer elements. From below, annulus pressure acts upwardly on a telescoping piston, forcing it further into engagement with the packer seals. Thus, the Allen device uses movable shoes/pistons both above and below the seal elements, and requires a plurality of moving sleeves, pistons, and other parts both above and below the seal elements in order to effect the disclosed self-energizing of the seals. The Allen seal elements are actuated in such a way that the movable sleeves/pistons which effect the increased energization engage the seal elements across only a part of their diameters and may cause extrusion of the elastomeric members around them at the upper and lower extremities of the stack of seal elements. Such extrusion around the sleeves and pistons may cause uneven stresses in or even damage to the seal elements, and could lead to seal failure.

Another approach to self-energization of a well packer due to pressure applied from both above and below the packer is disclosed in U.S. Pat. No. 3,459,261, issued Aug. 5, 1969, to Cochran. The Cochran device discloses a floating sleeve on which the seal element is mounted, the floating sleeve being slidable between abutments and responsive to fluid pressure applied from above and below the packer to increase the endwise compression of the seal. Like the Allen device, the Cochran packer thus has movable sleeves both above and below the seal element. The sliding sleeve of Cochran, however, must remain free to move up and down in order to effect self-energizing. Accordingly, in the event of pressure cycling, the sleeve may become stuck or may be prevented from moving fully or properly in one direction or the other to energize the seal.

Another approach to increasing seal energization is disclosed in U.S. Pat. No. 4,423,777, issued Jan. 3, 1984, to Mullins. The Mullins patent discloses a pressure chamber within a packer with dual-acting pistons, one piston setting the slips and the other piston compressing the seal elements. In the event that the seal elements begin to loosen, for example through extrusion, the Mullins patent discloses pressuring up through the central bore of the tool to the pressure chamber therewithin, thereby forcing the upper piston further into engagement with the seal elements and increasing the energization thereof.

Accordingly, there exists a need for a bridge plug which may effectively seal a wellbore and remain effective when subjected to pressures from above or below while in use. Additionally, there exists a need to effectively self-energize a seal on a downhole tool and maintain the energization of the seal when subjected to pressures from above or below the downhole tool.

SUMMARY OF INVENTION

In one aspect, the present invention relates to a downhole tool that includes a mandrel, a sealing element disposed around the mandrel, an upper cone disposed above the sealing element and a lower cone disposed below the sealing element, an upper slip assembly disposed above the upper cone and a lower slip assembly disposed below the sealing element, at least one lock ring configured to maintain energization of the sealing element when the downhole tool is set, and a secondary lock that couples the upper cone with the at least one lock ring.

In another aspect, the present invention relates to a method of increasing pack-off force of a downhole tool, the method including setting the downhole tool, the downhole tool including a mandrel, a sealing element, a lock ring, and a cone, and energizing further the sealing element by applying a differential pressure to the downhole tool.

In another aspect, the present invention relates to a method of retrofitting a downhole tool to reduce leakage of a seal, the method including providing a secondary lock disposed around a mandrel, the secondary lock including at least one arm having an axial portion extending downwardly therefrom and a threaded portion, and assembling the secondary lock to the downhole tool, the assembling including engaging the threaded portion of the secondary lock to a threaded surface of an upper cone disposed around the mandrel of the downhole tool.

Other aspects and advantages of the invention will be apparent from the following description and the appended claims.

DETAILED DESCRIPTION

In one aspect, embodiments of the invention relate to a downhole tool for sealing tubing or other pipe in a casing of a well. In particular, disclosed embodiments disclose a downhole tool, for example, a bridge plug or a packer, having a secondary lock to prevent leakage of fluids around the set downhole tool. Leakage often occurs when high pressure, that is pressure greater than the setting force, is applied to the downhole tool. Embodiments of the present invention may provide a more efficient and leak-resistant downhole tool for sealing tubing or pipe. Additionally, embodiments of the present invention may reduce loosening of the seal formed between the downhole tool and the tubing or pipe. Further, embodiments of the present invention may provide a method of further energizing a sealing element of a downhole tool after the downhole tool is set. Further still, embodiments of the present invention may provide a method of retrofitting a typical downhole tool with a secondary lock to reduce leakage of the seal.

Figure 1:
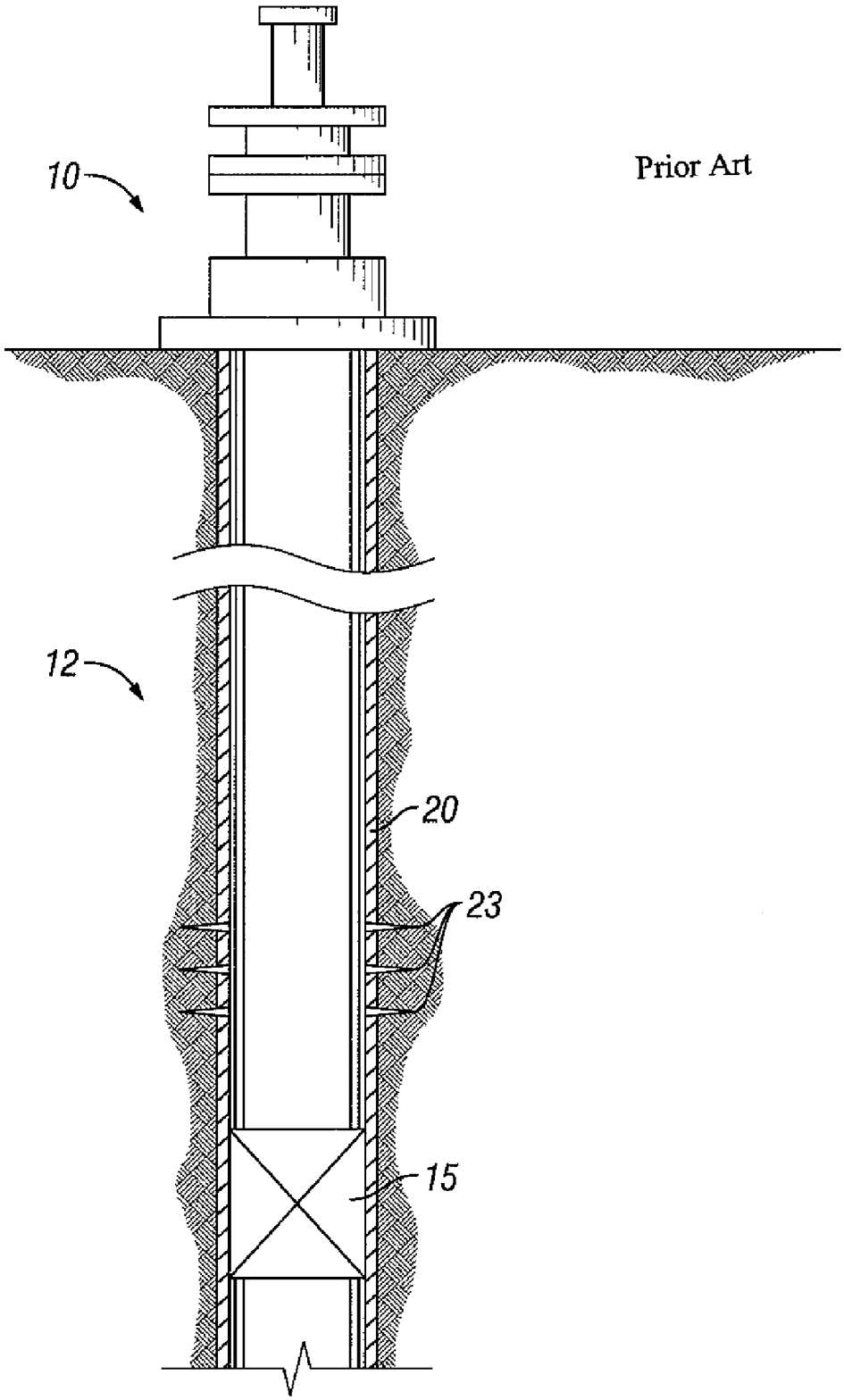
FIG. 1 is a section view of a wellbore with a bridge plug disposed therein.
Figure 2:
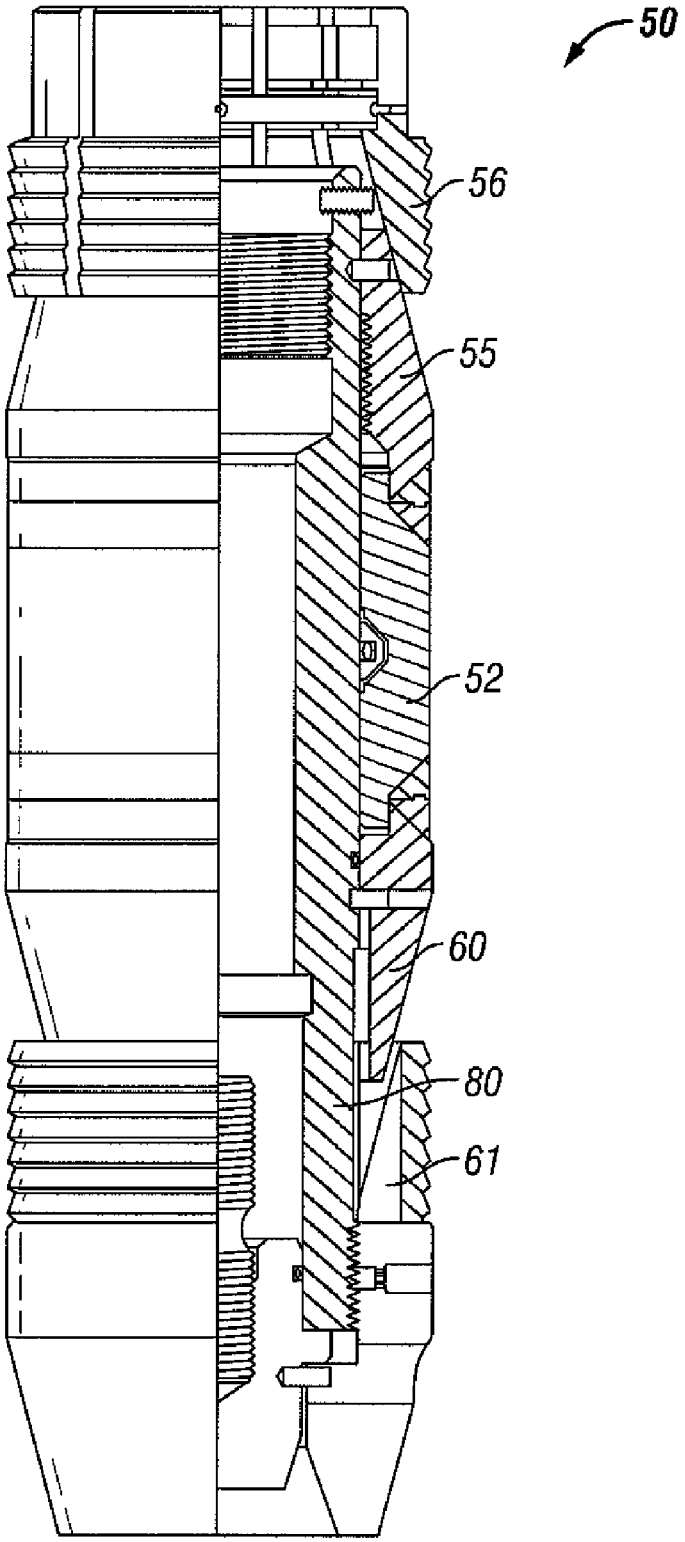
Prior Art FIG. 2
FIG. 2 is a partial cross sectional view of a prior art bridge plug.
Figure 3:
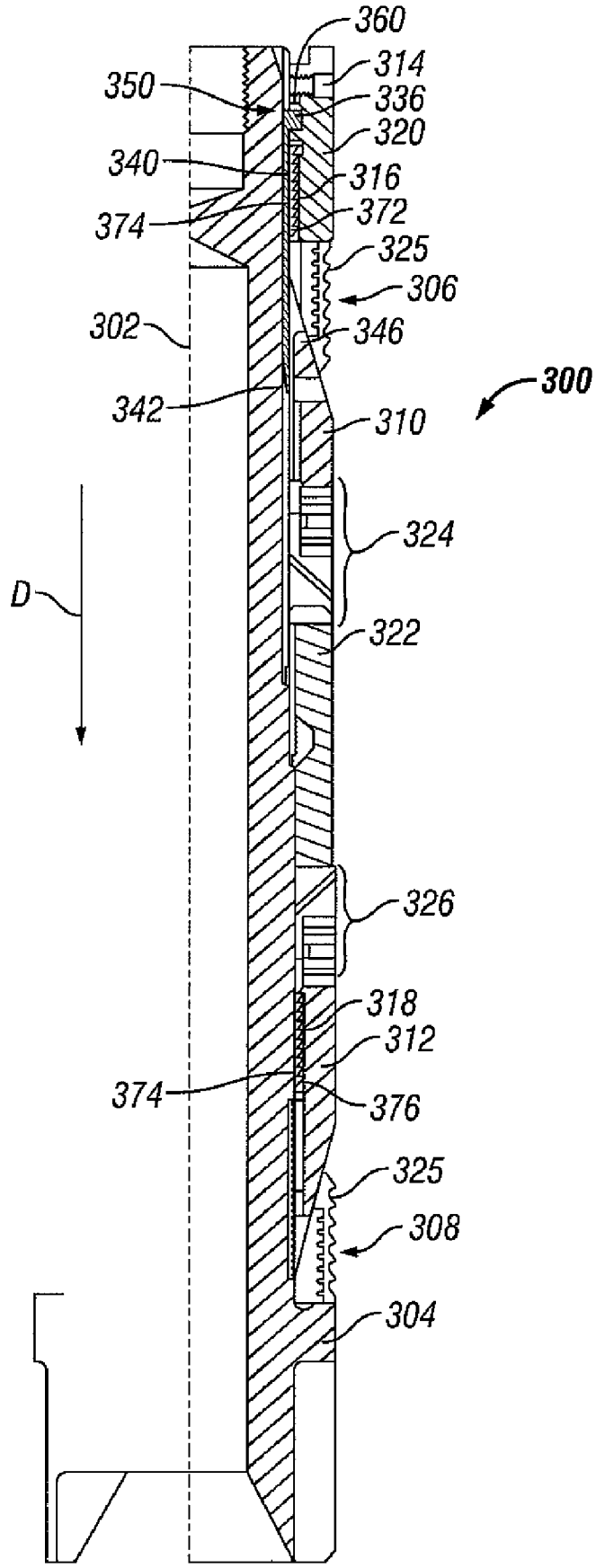
FIG. 3 shows a partial cross sectional view of a downhole tool before setting in accordance with an embodiment of the invention.

FIG. 3 shows a partial section view of downhole tool 300 in accordance with an embodiment of the invention. As used herein, a downhole tool may refer to a packer, a bridge plug, a whipstock packer, an anchor, or any other tool known in the art with a latching and sealing profile. The downhole tool 300 includes a central mandrel 304 having a center axis 302 about which most of the other components are mounted. In one embodiment, the outside diameter of the mandrel 304 may comprise a threaded portion 374. An upper slip assembly 306 and a lower slip assembly 308 are provided adjacent an upper cone 310 and a lower cone 312, respectively. The upper cone 310 may be held in place on the mandrel 304 by any means known in the art, for example, by one or more shear screws disposed through hole 314. An upper axial locking apparatus, or upper lock ring, 316 may be disposed between the mandrel 304 and a gage ring 320. A lower axial locking apparatus, or lower lock ring, 318 may be disposed between the mandrel 304 and the lower cone 312. The upper and lower lock rings 316, 318 comprise lock ring threaded portions 372, 376 configured to engage the threaded portion 374 of the mandrel 304. In one embodiment, the lock ring threaded portions 372, 376 and the threaded portion 374 of the mandrel may be buttress threads. One of ordinary skill in the art will appreciate that other threads or ratcheting profiles may be used. The upper and lower lock rings 316, 318 may prevent axial movement of the upper and lower slip assemblies 306, 308 and the upper and lower cones 310, 312 once the downhole tool has been set. An upper backup mechanism 324 is disposed around the mandrel 304 below the upper cone 310 and above a sealing element 322. The sealing element 322 may be formed of any material known in the art, for example, elastomer or rubber. A lower backup mechanism 326 is disposed around the mandrel 304 above the lower cone 312 and below the sealing element 322. The upper and lower backup mechanisms 324, 326 may include a plurality of backup rings. The backup rings may include, for example, a segmented backup ring, a frangible backup ring, a non-frangible backup ring, a sacrificial backup ring, and/or a solid backup ring, as disclosed in U.S. Publication 2005/0189103, assigned to the assignee of the present invention, and incorporated herein by reference in its entirety.

In one embodiment, the downhole tool 300 further includes a secondary lock 350 that couples the upper lock ring 316 with the upper cone 310 to prevent movement of the upper slip assembly 306 and may further energize the sealing element 322. In one embodiment, the secondary lock 350 couples the gage ring 320 with the upper cone 310, thereby coupling the upper lock ring 316 with the upper cone 310. In another embodiment, the secondary lock 350 may be integrally formed with the gage ring 320. In yet another embodiment, the secondary lock 350 may be formed separately.

Figure 4:
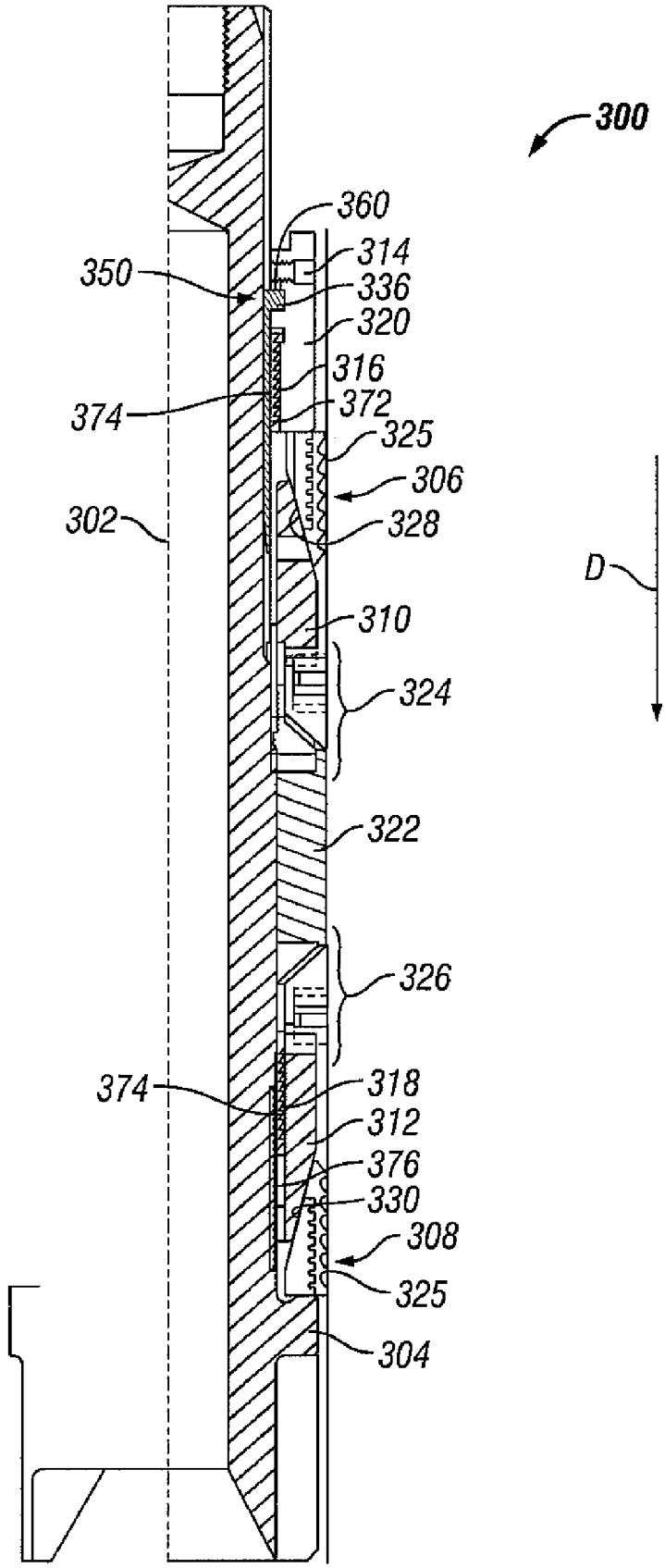
FIG. 4 shows a partial cross sectional view of a downhole tool during setting in accordance with and embodiment of the invention.
Figure 5:
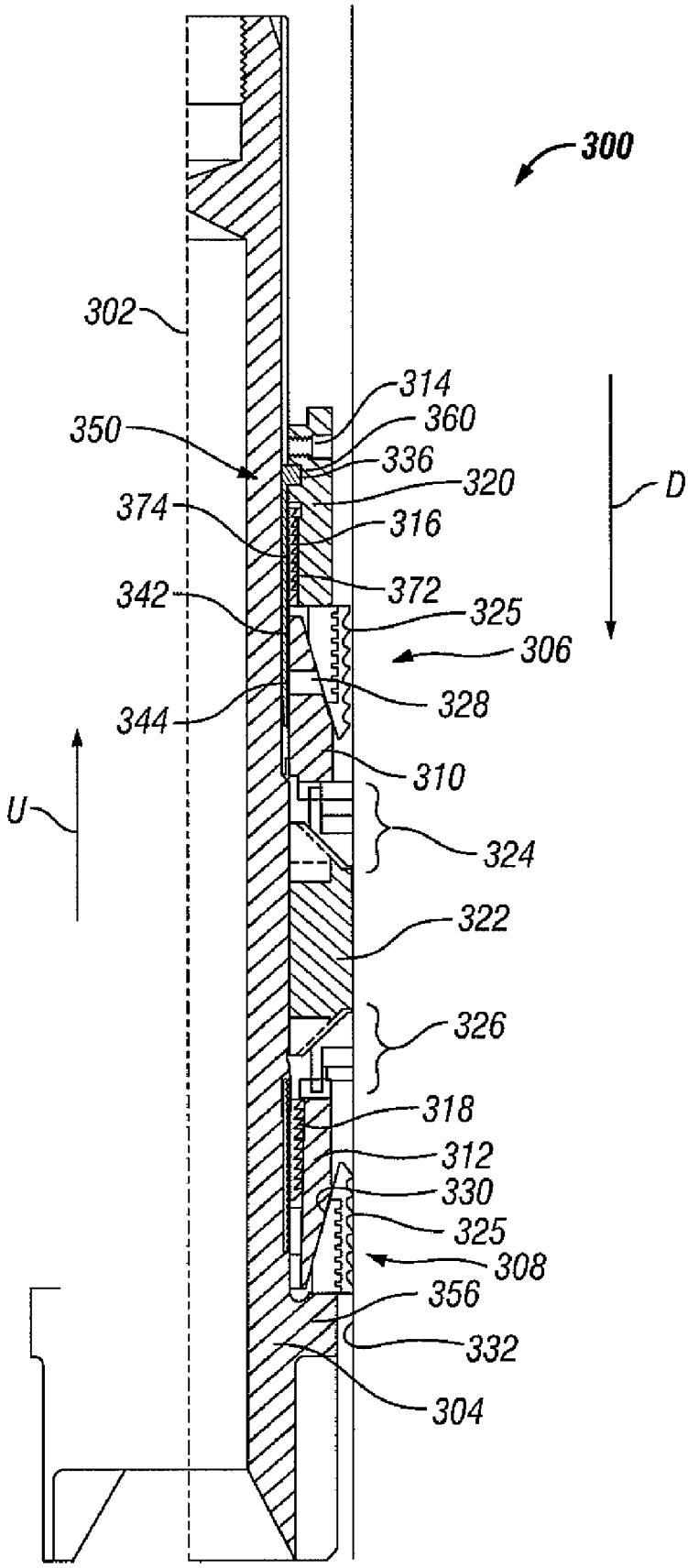
FIG. 5 shows a partial cross sectional view of a set downhole tool in accordance with an embodiment of the invention.
Figure 6:
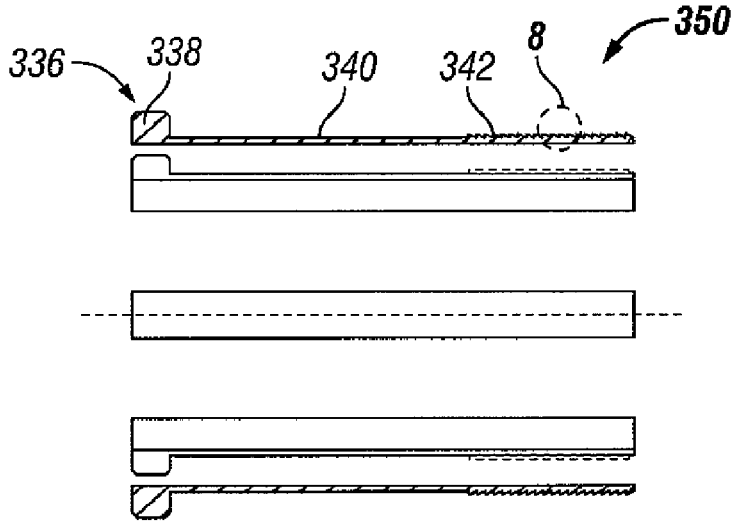
FIG. 6 shows a secondary lock in accordance with an embodiment of the invention.
Figure 7:
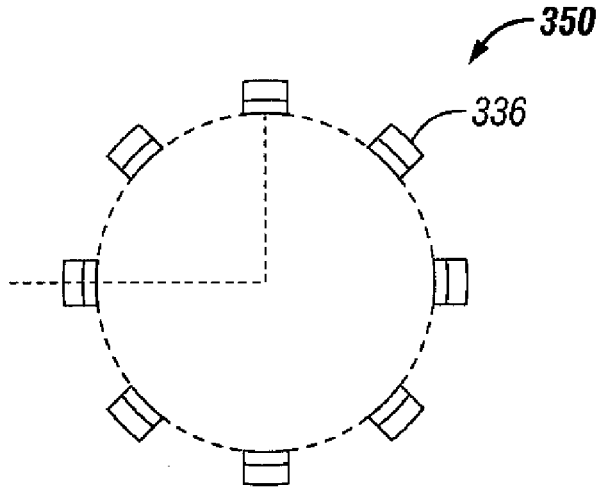
FIG. 7 shows a top view of the secondary lock of FIG. 6 in accordance with an embodiment of the invention.
Figure 9:
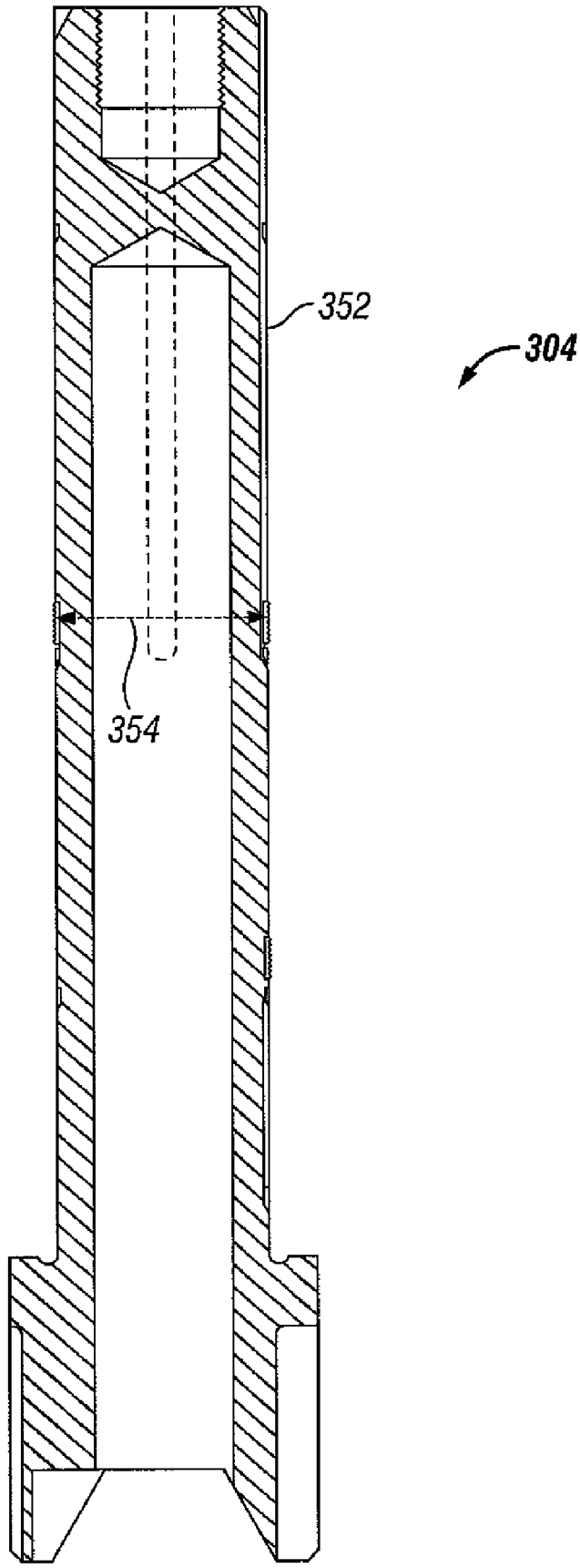
FIG. 9 shows a mandrel for a downhole tool in accordance with an embodiment of the invention.
Figure 10:
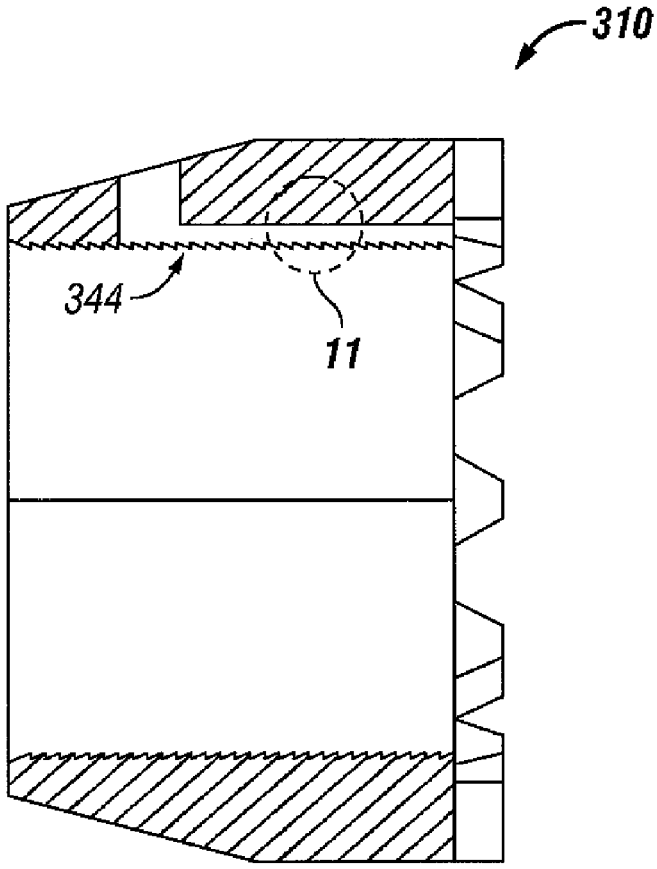
FIG. 10 shows an upper cone in accordance with an embodiment of the invention.

In the embodiment shown in FIGS. 3-5, the secondary lock 350 includes at least one arm 336 disposed radially inside the gage ring 320 and extending axially downward along the mandrel 304. In this embodiment, as shown in FIG. 6, the at least one arm 336 includes an extended portion 338, an axial portion 340, and a threaded portion 342. At least one arm 336, or a plurality of arms, as shown in FIGS. 6 and 7, may be cut from a ring at pre-selected locations around the circumference of the ring. Referring back to FIGS. 3-5, the extended portion 338 of the at least one arm 336 may be disposed in a groove 360 formed on an inside diameter of the gage ring 320. The axial portion 340 of the at least one arm 336 is disposed in at least one corresponding axial groove 352 formed on an outside diameter 354 of the mandrel 304, as shown in FIG. 9. In one embodiment, the outside diameter 354 of the mandrel 304 may be threaded, for example with a thread axially biased in one direction with, for example, a buttress thread. One of ordinary skill in the art will appreciate that other threads or ratcheting profiles may be used. The axial portion 340 of the at least one arm 336 extends axially downward D within the at least one groove 352 along the mandrel 304. In this embodiment, the at least one arm 336 is disposed radially inward of the upper slip assembly 306. The threaded portion 342 of the at least one arm 336 may be configured to threadedly engage a threaded surface 344 on an inside diameter of the upper cone 310, shown in greater detail in FIGS. 10 and 11.

Figure 8:
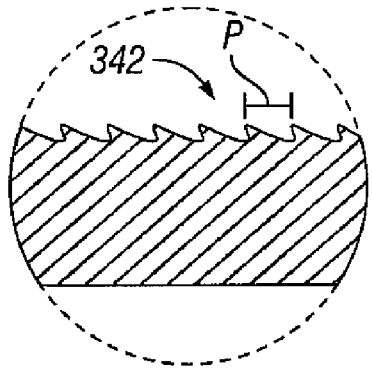
FIG. 8 shows a detail view of a threaded portion of the secondary lock of FIG. 6 in accordance with an embodiment of the invention.

FIG. 8 shows a detail view of the portion labeled '8' in FIG. 6 of the threaded portion 342 of the at least one arm 336. In this embodiment, the threaded portion 342 of the at least one arm 336 includes threads axially biased in one direction, for example, buttress threads. That is, the threaded portion 342 is configured so that the at least one arm 336 may move downward (indicated as D in FIG. 3) when engaged with the threaded surface 344 of the upper cone 310, or the upper cone 310 may move upward (U, FIG. 5) over the threaded portion 342. However, when engaged, movement between the upper cone 310 and the threaded portion 342 in the opposite direction, that is, downward D movement of the upper cone 310 and upward U movement of the threaded portion 342, is limited to less than or equal to one pitch, indicated at P of FIG. 8, of the threaded portion 342.

Figure 11:
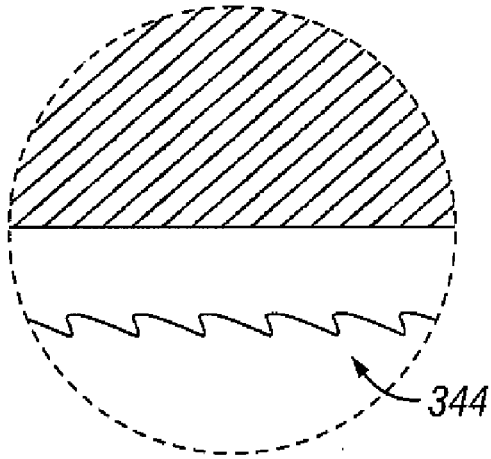
FIG. 11 shows a detailed view of a threaded surface of the upper cone of FIG. 10 in accordance with an embodiment of the invention.
Figure 12:
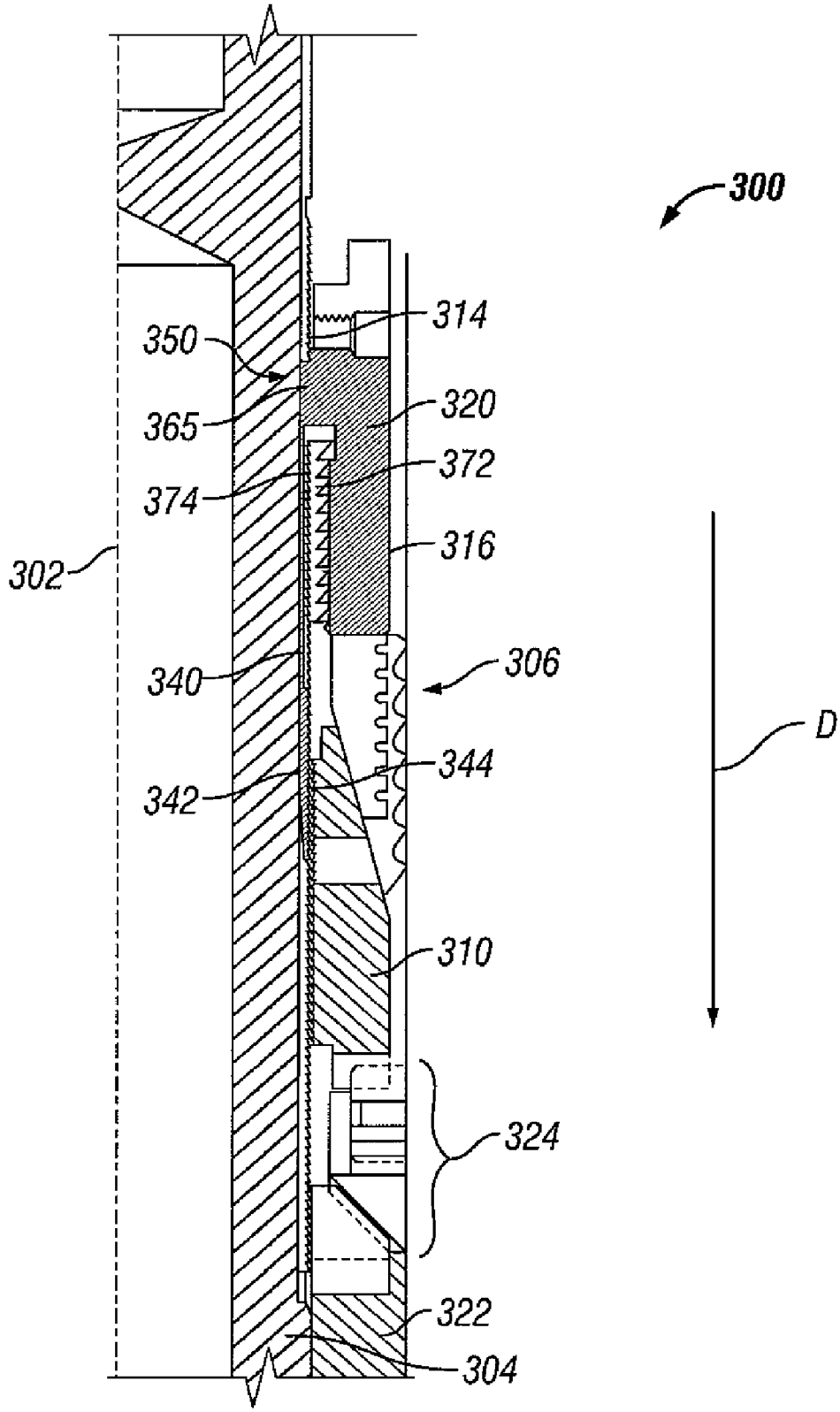
FIG. 12 shows a partial cross sectional view of a downhole tool in accordance with an embodiment of the invention.

In another embodiment, the secondary lock 350 includes at least one arm 365 integrally formed radially inside the gage ring 320 and extending axially downward D along the mandrel 304, as shown in FIG. 12. In this embodiment, the at least one arm 365 comprises an axial portion 340, and a threaded portion 342. A plurality of arms may be integrally formed at pre-selected locations around the circumference of the gage ring 320. The axial portion 340 of the at least one arm 365 is disposed in at least one corresponding axial groove 352 formed on an outside diameter 354 of the mandrel 304, as shown in FIG. 9. In one embodiment, the outside diameter 354 of the mandrel 304 may be threaded, for example with a buttress thread. One of ordinary skill in the art will appreciate that other threads or ratcheting profiles may be used. The axial portion 340 of the at least one arm 365 extends axially downward D within the at least one groove 352 along the mandrel 304. In this embodiment, the at least one arm 365 is disposed radially inward of the upper slip assembly 306. The threaded portion 342 of the at least one arm 365 may be configured to engage a threaded surface 344 on an inside diameter of the upper cone 310, for example with corresponding axially biased threads, as shown in greater detail in FIGS. 10 and 11.

Figure 13:
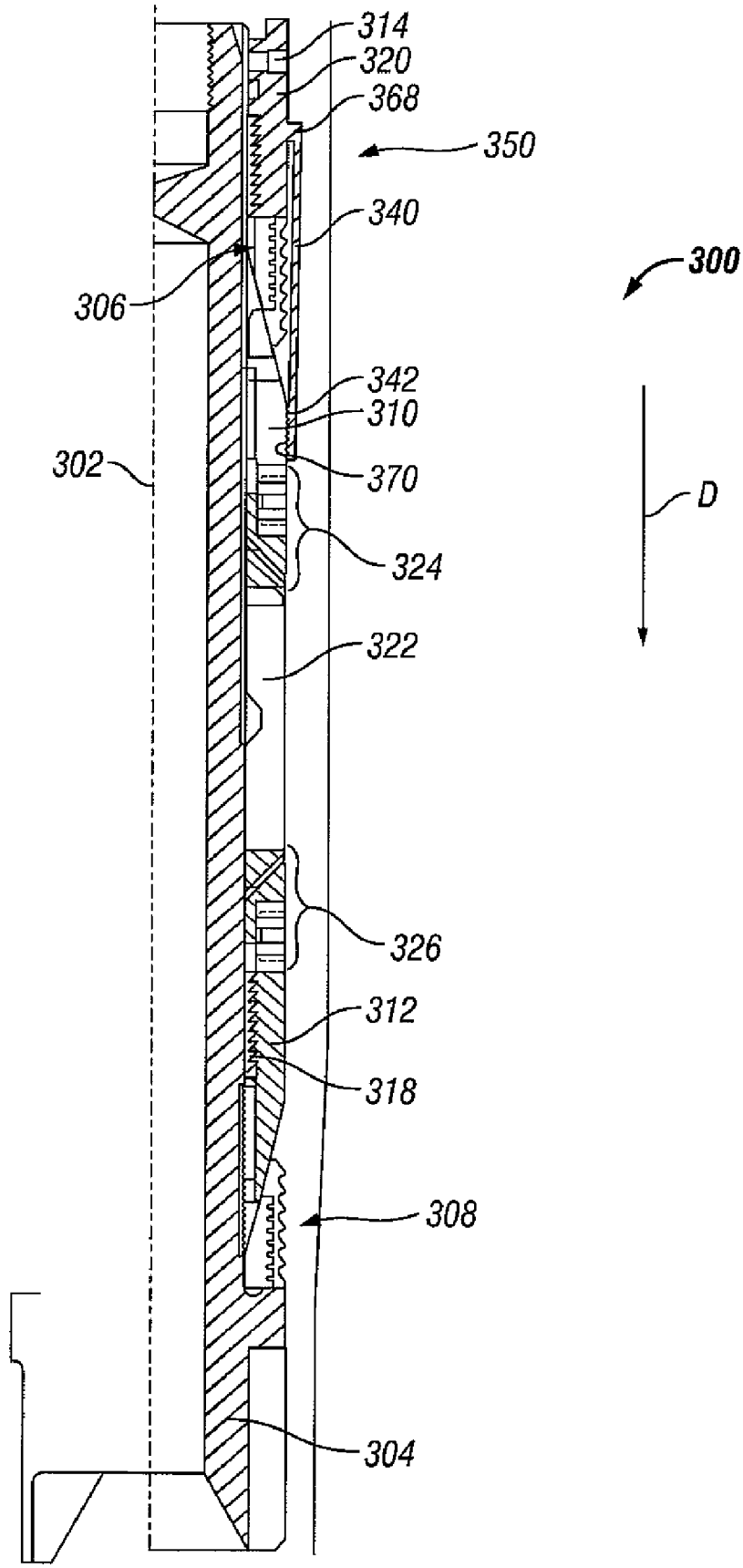
FIG. 13 shows a partial cross sectional view of a downhole tool in accordance with an embodiment of the invention.

Alternatively, the secondary lock 350 may include at least one arm 368 formed radially outside the gage ring 320 extending axially downward D, as shown in FIG. 13. In this embodiment, the at least one arm 368 may be integrally or separately formed with the gage ring 320. The at least one arm 368 includes an axial portion 340, and a threaded portion 342. A plurality of arms may be integrally formed or separately coupled at pre-selected locations around the circumference of the ring. The upper slip assembly 306 may be formed with at least one corresponding axial groove (not shown) to accommodate the at least one arm 368 of the secondary lock 350 when the upper slip assembly is expanded radially outward. The axial portion 340 of the at least one arm 368 extends axially downward D and the threaded portion 342 of the at least one arm 368 may be configured to engage a threaded surface 370 on an outside diameter of the upper cone 310 with, for example, axially biased threads. One of ordinary skill in the art will appreciate that other threads or ratcheting profiles may be used.

Operation

In one embodiment, to set the downhole tool 300, as shown in FIGS. 4 and 5, pressure is applied from above the downhole tool 300. The downhole tool 300 may be set by wireline, hydraulically on coil tubing, or conventional drill string. In this embodiment, a setting tool pulls upwardly on the mandrel 304, thereby shearing a shear screw (not shown) disposed in the hole 314. The upper and lower cones 310, 312 are moved downward (D) along the mandrel 304, radially expanding upper and lower backup mechanisms 324, 326. The gage ring 320 moves downward D, thereby moving upper slip assembly 306 downward D along tapered surface 328 of the upper cone 310. The upper slip assembly 306 is configured to break as the upper slip assembly 306 moves along tapered surface 328 of the upper cone 310, thereby radially outwardly extending the slip assembly 306. The upper slip assembly 306 radially outwardly extends the slip teeth 325 into contact with the inner wall 332 of the casing. As the gage ring 320 moves downward D, the at least one arm 336 of the secondary lock 350 moves downward D and the threaded portion 342 of the at least one arm 336 engages the threaded surface 344 of the upper cone 310, thereby preventing the gage ring 320 and the upper lock ring 316 from separating from the upper cone 310. A tapered surface 330 of the lower cone 312 moves the lower slip assembly 308 radially outward and into contact with the inner wall 332 of the casing. The sealing element 322 is compressed between the upper cone 310 and upper backup mechanism 324 and the lower cone 312 and lower backup mechanism 326, thereby radially extending the sealing element 322 into contact with an inner wall 332 of the casing. The sealing element 322 is then said to be energized and creates a seal between sections or zones of the casing or tubing. Once set, energization of the sealing element 322 is maintained by a lock ring 316, which mechanically retains a pack-off force in the sealing element 322 of the downhole tool 300. As used herein, pack-off force refers to the resultant force of the sealing element of the downhole tool when in contact with the casing or wellbore.

As shown in FIG. 5, differential pressure may move mandrel 302 within the downhole tool 300. For example, in the event pressure is applied from below the set downhole tool 300, the mandrel 304 may move upward U while the upper cone 310 and upper slip assembly 306 remain stationary. Typically, as the mandrel 304 moves upward, the upper cone 310 and the upper lock ring 316 may slightly separate. To maintain energization of sealing element 322 and further energize the sealing element 322 when pressure from below the set downhole tool 300 is applied, the secondary lock 350 may be configured to couple the upper lock ring 316, disposed in the gage ring 320, and the upper cone 310.

In this embodiment, separation of the upper lock ring 316 and the upper cone 310 is limited by engagement of threaded surface 344 of the upper cone 310 and the threaded portion 342 of the at least one arm 336 of the secondary lock 350. As shown in FIGS. 8 and 11, the threads of the threaded portion 342 of the at least one arm 336 and the threaded surface 344 of the upper cone 310 are configured so that when engaged, the gage ring 310 and the upper lock ring 316, disposed therein, may move in only one direction. In one embodiment, the at least one arm 336 may be configured to move downward D along the upper cone 310. In this embodiment, movement between the upper cone 310 and the threaded portion 342 of the at least one arm 336 in the opposite direction, that is, upward (U) movement of the threaded portion 342, is limited to less than or equal to one pitch (indicated at P of FIG. 8) of the threaded portion 342.

Accordingly, coupling of the gage ring 320 and the upper lock ring 316 with the upper cone 310 is maintained.

In one embodiment shown in FIG. 5, mandrel 304 may move upward due to, for example, differential pressure. A threaded portion 374 of the mandrel 304 and a lock ring threaded portion 372 are configured so that the mandrel 304 may move upward U through the upper lock ring 316, but is limited to less than or equal to one pitch of the upper lock ring threaded portion 372 in a downward D direction. In one embodiment, a threaded portion 374 on the outside diameter of the mandrel 304 and the upper lock ring threaded portion 372 may be buttress threads. One of ordinary skill in the art will appreciate that other threads or ratcheting profiles may be used. As discussed above, the secondary lock 350 limits the upward U movement of the upper lock ring 316 to less than or equal one pitch of the threaded portion 340 of the at least one arm 336 of the secondary lock 350. Accordingly, as the mandrel 304 moves upward, the threaded portion 374 of the mandrel 304 ratchets upward through the upper lock ring threaded portion 372 (shown in more detail in FIG. 12), thereby further energizing the sealing element 322. In the event differential pressure is reduced, downward movement of the mandrel 304 is limited to less than or equal to one pitch of the upper lock ring threaded portion 372. By coupling the upper cone 310 and the upper lock ring 316, the secondary lock 350 allows the increased pack-off force due to the upward U movement of the mandrel 304 to be retained in the sealing element 322 of the downhole tool 300.

In one example, the pack-off force of a set downhole tool 300 (shown in FIG. 5) may be approximately 35,000 lbs after setting the downhole tool 300. When pressure is applied from below the downhole tool 300, the mandrel 304 ratchets upward U through the upper lock ring 316 coupled to the upper cone 310 by the secondary lock 350, thereby increasing the pack-off force of the downhole tool to approximately 125,000 lbs. Accordingly, the sealing element 322 of the downhole tool 300 is said to be further energized. Because the mandrel 304 is limited from moving downward by the engagement of the threaded portion 374 of the mandrel 304 and the upper lock ring threaded portion 372, the increased pack-off force of the downhole tool 300 is retained. One of ordinary skill in the art will appreciate that the pack-off force of the set downhole tool may vary depending on the downhole tool, the pressure applied, and the wellbore or casing in which the downhole tool is disposed. Additionally, one of ordinary skill in the art will appreciate that the increased pack-off force of the further energized sealing element of the downhole tool may vary depending on the downhole tool, the differential pressure, and the wellbore or casing in which the downhole tool is disposed.

Retrofitting

A typical downhole tool may be retrofitted to reduce the amount of leakage of a sealing element in accordance with embodiments of the invention. In one embodiment, a typical downhole tool may be retrofitted to reduce leakage of the seal by providing a secondary lock formed in accordance with embodiments of the invention, as described above. In one embodiment, the secondary lock includes at least one arm having an axial portion and a threaded portion. In this embodiment, the secondary lock may be assembled to the downhole tool by engaging the threaded portion of the secondary lock to a threaded surface of the upper cone.

In one embodiment, as shown in FIGS. 3-5, providing a secondary lock 350 comprises forming the at least one arm 336 separately, wherein the at least one arm 336 further comprises an extended portion 340 configured to engage a groove 360 on the inside diameter of the gage ring 320. In this embodiment, the at least one arm 336 of the secondary lock 350 may be disposed along the mandrel 304. A groove 352 may be formed on an outside diameter of the mandrel 304 to accommodate the axial portion 340 of the at least one arm 336. Alternatively, as shown in FIG. 12, the at least one arm 365 may be integrally formed with the gage ring 320.

In another embodiment, as shown in FIG. 13, providing a secondary lock 350 includes integrally or separately forming at least one arm 368 coupled to the outside diameter of the gage ring 320. In this embodiment, the axial portion 340 of the at least one arm 368 extends downwardly, and a threaded portion 342 engages an outside diameter of the upper cone 310. In this embodiment, corresponding axial grooves may be formed in the upper slip assembly configured to receive the at least one arm 368 when the upper slip assembly is in an expanded position.

Advantageously, the present invention provides for a downhole tool that efficiently and effectively seals a tubing or casing in a wellbore. Further, embodiments of the invention provide a downhole tool that may reduce leakage of the seal formed between the tool and a casing wall. Further still, embodiments of the invention provide a method for retrofitting a downhole tool to reduce leakage of the seal formed between the tool and the casing.

While the invention has been described with respect to a limited number of embodiments, those skilled in the art, having benefit of this disclosure, will appreciate that other embodiments may be devised which do not depart from the scope of the invention as disclosed herein. Accordingly, the scope of the invention should be limited only by the attached claims.

What is claimed is:

1. A downhole tool comprising:

a mandrel;

a sealing element disposed around the mandrel;

an upper cone disposed above the sealing element and a lower cone disposed below the sealing element;

an upper slip assembly disposed above the upper cone and a lower slip assembly disposed below the sealing element;

at least one lock ring configured to maintain energization of the sealing element after the downhole tool is set;

a gage ring disposed above the upper cone and configured to engage the upper slip assembly and the at least one lock ring; and a secondary lock that couples the upper cone to the gage ring, thereby coupling the upper cone with the at least one lock ring, wherein after the downhole tool is set at least one slip assembly is configured to be translated toward the sealing element and secured to further energize the sealing element during a pressure differential.

2. The downhole tool of claim 1, wherein the at least one lock ring is disposed within the gage ring.

3. The downhole tool of claim 2, wherein the secondary lock comprises at least one arm having an axial portion coupled to the gage ring and extending downwardly therefrom and a threaded portion configured to engage a threaded surface of an inside diameter of the upper cone.

4. The downhole tool of claim 3, wherein the at least one arm is disposed on an inside diameter of the gage ring.

5. The downhole tool of claim 3, wherein the at least one arm is disposed on an outside diameter of the gage ring.

6. The downhole tool of claim 3, wherein the threaded portion of the at least one arm is biased in one direction.

7. The downhole tool of claim 3, wherein the threaded surface of the upper cone is biased in one direction.

8. The downhole tool of claim 3, wherein the at least one arm is integrally formed with the gage ring.

9. The downhole tool of claim 3, further comprising at least one corresponding axial groove formed in an outside diameter of the mandrel and configured to receive an axial portion of the at least one arm.

10. The downhole tool of claim 5, wherein the upper slip assembly comprises at least one axial groove configured to receive the at least one arm.

11. The downhole tool of claim 1, further comprising an upper back up mechanism disposed around the mandrel and above the sealing element and a lower backup mechanism disposed around the mandrel and below the sealing element.

12. A method of retrofitting a downhole tool to reduce leakage of a seal, the method comprising:

providing a lock disposed around a mandrel, the lock comprising at least one arm comprising an axial portion and a threaded portion, wherein the axial portion extends from an upper cone to a gage ring disposed above the upper cone; and assembling the lock to the downhole tool the assembling comprising engaging the threaded portion of the lock to a threaded surface of the upper cone disposed around the mandrel of the downhole tool, wherein after the downhole tool is set at least one slip assembly is configured to be translated toward a sealing element and secured to further energize the sealing element during a pressure differential.

13. The method of claim 12, further comprising forming at least one corresponding axial groove in an outside diameter of the mandrel of the downhole tool configured to receive the axial portion of the lock.

14. The method of claim 12, wherein the providing a lock further comprises forming the at least one arm integrally to the gage ring of the downhole tool.

15. The method of claim 12, wherein the providing a lock further comprises forming the at least one arm separately, wherein the at least one arm comprises an extended portion configured to engage a groove on an inside diameter of the gage ring.

16. The method of claim 12, further comprising forming at least one corresponding axial groove in an upper slip assembly configured to receive the at least one arm of the lock when the upper slip assembly is in an expanded position.

* * * * *